US010553990B2

(12) United States Patent
Grimm

(10) Patent No.: US 10,553,990 B2
(45) Date of Patent: Feb. 4, 2020

(54) OVERMOLDED ADAPTER

(71) Applicant: Amphenol-Tuchel Electronics GmbH, Heilbronn (DE)

(72) Inventor: Michael Grimm, Mosbach (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/098,938

(22) PCT Filed: Apr. 28, 2017

(86) PCT No.: PCT/EP2017/060276
§ 371 (c)(1),
(2) Date: Nov. 5, 2018

(87) PCT Pub. No.: WO2017/191066
PCT Pub. Date: Nov. 9, 2017

(65) Prior Publication Data

US 2019/0089092 A1 Mar. 21, 2019

(30) Foreign Application Priority Data

May 4, 2016 (DE) ..... 10 2016 108 314

(51) Int. Cl.

| | |
|---|---|
| ***H01R 4/38*** | (2006.01) |
| ***H01R 13/59*** | (2006.01) |
| ***H01R 13/622*** | (2006.01) |
| ***H01R 13/58*** | (2006.01) |
| ***H01R 43/24*** | (2006.01) |
| ***H01R 43/20*** | (2006.01) |

(52) U.S. Cl.
CPC ..... *H01R 13/59* (2013.01); *H01R 13/5845* (2013.01); *H01R 13/622* (2013.01); *H01R 43/20* (2013.01); *H01R 43/24* (2013.01)

(58) Field of Classification Search
CPC ..... H01R 13/59; H01R 13/595; H01R 43/20; H01R 43/24; H01R 13/622
USPC ..... 439/320–323, 605, 607, 736
See application file for complete search history.

(56) References Cited

U.S. PATENT DOCUMENTS

| | | | |
|---|---|---|---|
| 2,949,642 | A | 3/1957 | Lieberman |
| 5,529,513 | A | 6/1996 | Lee |
| 5,641,307 | A | 6/1997 | Gerrans |

(Continued)

FOREIGN PATENT DOCUMENTS

| | | | |
|---|---|---|---|
| DE | 202007011195 | U1 | 11/2007 |
| DE | 102008051468 | A1 | 4/2010 |

(Continued)

*Primary Examiner* — Khiem M Nguyen
(74) *Attorney, Agent, or Firm* — Blank Rome LLP

(57) ABSTRACT

The invention relates to an arrangement (100) consisting of a connector housing (10) and a cylindrical, overmoulded adapter sleeve (20) for screwing onto the connector housing (10), wherein the overmoulded adapter sleeve (20) has a thread (22) at one end (21*a*) for connection to a mating thread (12) of the connector housing (10), and the overmoulded adapter housing (20) has an inner channel (23) through which a cable (30) can be passed, wherein a plurality of ribs (25) and/or grooves (26) are furthermore provided on the outer lateral surface (24) of the overmoulded adapter sleeve (20), and the region with the ribs (25) and/or grooves (26) is suitably designed to be overmoulded with a plastic together with a cable (30) in an overmoulding die.

10 Claims, 3 Drawing Sheets

(56) References Cited

U.S. PATENT DOCUMENTS

| | | | | |
|---|---|---|---|---|
| 7,641,494 | B2 * | 1/2010 | Chen | H01R 13/5845 29/858 |
| 9,190,763 | B2 * | 11/2015 | Csak | H01R 13/504 |
| 2004/0082222 | A1 | 4/2004 | Okamura | |
| 2009/0186506 | A1 | 7/2009 | Chen et al. | |

FOREIGN PATENT DOCUMENTS

| | | | |
|---|---|---|---|
| DE | 202011105202 | U1 | 12/2011 |
| EP | 2575222 | A2 | 4/2013 |
| GB | 2304238 | A | 3/1997 |

* cited by examiner

OVERMOLDED ADAPTER

RELATED APPLICATIONS

This application is a national stage application of International Application No. PCT/EP2017/060276, filed Apr. 28, 2017, which claims priority to German Patent Application No. 10 2016 108 314.3, filed May 4, 2016, the entire disclosures of which are hereby incorporated by reference.

The present invention relates to an arrangement comprising a plug connector housing and an overmold adaptor sleeve, and to an overmolded plug connector that is preassembled with a cable and to a method for producing such a plug connector.

It is known in the prior art that plug connectors are arranged at the end of a line or at the end of a set of cables. It is necessary for this purpose that the plug connectors comprising a plug and a mating plug are provided with a strain relief arrangement to enable the cable to absorb the pull or also compressive forces that are acting on the plug connector and thus to relieve the contacts within the plug connector of these influencing forces, in particular to avoid or to prevent errors and impairments.

It is known in the electrical installation industry that a plug connector housing comprises a transverse bolt that may be screwed to the plug connector housing and is arranged over an end region of the cable and exerts a compressive force on the cable sheath after said transverse bolt has been screwed to said plug connector housing.

A further solution known in the prior art is the use of strain relief elements that may be screwed to the cable. A cable screw connection is generally performed in such a manner that the screwing procedure produces an increasing compressive force on the cable and for example a clamp cage encompasses and retains the cable.

Such plug connectors are generally configured as reconnectable plug connectors that have the disadvantage that the cable screw connections are also unintentionally released and the plug connector becomes insecure.

In addition to such reconnectable plug connectors, so-called non-reconnectable plug connectors are known in the prior art. When producing such plug connectors, it is usual to produce the plug connector housing in one overmolding/casting method, wherein during the overmolding/casting procedure the region of the cable that issues directly into said housing is placed simultaneously into the overmolding/casting tool and is likewise overmolded with the identical material as the material of the plug connector housing.

This is associated with the disadvantage that the finished plug connector housing frequently does not connect sufficiently with the material of the cable sheath since the demands placed on the material of the plug connector housing are completely different to the demands that are placed on the material of the cable sheath.

A further disadvantage resides in the fact that when producing such plug connector constructions it is always only possible to produce one non-reconnectable plug connector. However, if a user wishes to use such a plug connector as a reconnectable plug connector, then it is necessary to design a completely new plug connector.

It is therefore desirable that existing reconnectable plug connectors to which a cable screw connection is usually to be attached as a cable seal and strain relief are designed in such a manner that such a plug connector may be used both as a reconnectable plug connector and also as a non-reconnectable plug connector.

The object of the invention is therefore to overcome the aforementioned disadvantages and to propose a plug connector that on the one hand may be used as a reconnectable plug connector and on the other hand may also be used as a non-reconnectable plug connector.

In particular, it is the object of the present invention to propose a solution as how to attach an overmolding to an actual reconnectable plug connector without having to make significant modifications to the design of the plug connector or to make any modifications at all to the design of the plug connector.

This object is achieved with an arrangement in accordance with the features of claim 1 and with a plug connector having the features of claim 8 and with a method having the features of claim 11 and also of claim 12.

A basic idea of the present invention resides in providing a specifically configured overmold adaptor sleeve that may be screwed to the plug connector housing and simultaneously comprises contours that render it possible to provide a stable overmolding around the overmold adaptor sleeve.

The invention proposes for this purpose an arrangement comprising a plug connector housing and a cylindrical overmold adaptor sleeve for screwing to the plug connector housing, wherein the overmold adaptor sleeve comprises a thread at one end so as to be connected to a mating thread of the plug connector housing and the overmold adaptor sleeve comprises an inner extending channel for feeding through a cable, wherein moreover multiple ribs and/or grooves are provided on the outer surface of the overmold adaptor sleeve and the region that comprises the ribs and/or grooves is expediently configured so as to achieve the collective overmolding with a synthetic material in an overmolding tool with a cable.

It is particularly advantageous in this case if the overmold adaptor sleeve comprises a thread that renders it possible to screw said overmold adaptor sleeve to a thread on a plug connector housing that was originally intended to be connected to a cable screw connection.

As a result, it is possible in accordance with the invention to create a non-reconnectable plug connector from a reconnectable plug connector. For this purpose, a method is to be provided in accordance with the invention that renders it possible to modify a reconnectable plug connector, which comprises a releasable cable screw connection, to produce a non-connectable plug connector, said method comprising the following steps:

a. Release and remove the cable screw connection;
b. Attach the overmold adaptor sleeve and
c. Overmold the plug connector in the region of the overmold adaptor sleeve collectively with a cable section of the cable that is located directly at the cable entry-side feedthrough opening of the overmold adaptor sleeve.

In one advantageous embodiment of the invention, the aforementioned arrangement is characterized in that the ribs and/or grooves of the overmold adaptor sleeve are provided on the outside in part or completely extending around the overmold adaptor sleeve.

It is further advantageous that multiple ribs are provided on the outside extending around the overmold adaptor sleeve.

In a further embodiment of the invention it is provided that the overmold adaptor sleeve is formed from a housing-side section, a cable entry-side section and an intermediate section that lies between the two said sections, wherein the ribs and/or grooves are provided in the region of the cable entry-side section.

It is further advantageous if moreover the intermediate section is provided with a receiving groove, into which it is possible to introduce or releasably clip in a resilient, preferably annular or part-annular adaptor element or said adaptor element is introduced into said receiving groove.

It is further advantageous if the color of the adaptor element differs from the color of the plug connector with the result that consequently visible color codes may be attached to the plug connector housing.

It is further advantageous if the receiving groove is arranged between two collars that protrude toward the outer periphery in the housing-side section. It is further advantageous if the two collars also protrude toward the outer periphery of the cable entry-side section, in particular toward the ribs.

In a further advantageous embodiment of the invention, it is provided that moreover two diametrically opposite key flats are provided on the overmold adaptor sleeve so as to engage with a tool. It is particularly advantageous if the key flats likewise protrude over the ribs of the overmold adaptor sleeve with the result that said ribs are collectively overmolded during the overmolding procedure and the overmolding is provided with an additional hold.

A further aspect of the present invention relates to an overmolded plug connector that is pre-assembled with a cable and comprises an arrangement, as previously described, wherein the overmold adaptor sleeve is screwed to the plug connector housing and said plug connector is provided in the region of the multiple ribs and/or grooves with a synthetic material overmolding, wherein the synthetic material overmolding encompasses at least one part of the cable sheath of the cable in a positive-locking manner.

In a further advantageous embodiment of the invention, it is provided that the plug connector comprises on the plug connector housing a rotatably mounted screw connection sleeve for screwing to a correspondingly configured plug connector, in other words to a mating plug, and provided between the screw connection sleeve and the plug connector housing is an annular gap into which protrudes an annular, housing-side section of the overmold adaptor sleeve, said annular, housing-side section being provided with the thread of the overmold adaptor sleeve.

The annular gap is configured as an annular gap that is open in the plug-in direction with the result that as the overmold adaptor sleeve is plugged on in the assembly direction, said overmold adaptor sleeve may be introduced with its threaded section into the annular gap, in that said overmold adaptor sleeve is screwed on the thread and at each thread moves a little further into the annular gap.

It is particularly advantageous if moreover a seal is located in the region of the annular gap, said seal being arranged between the annular, housing-side section of the overmold adaptor sleeve and the plug connector housing with the result that as the overmold adaptor sleeve is screwed into the annular gap the overmold adaptor sleeve lies with a sealing flange against the seal as soon as the overmold adaptor sleeve has been moved into its final screwed-in position.

It is further advantageous if a casting mass is introduced between the sheath of the cable and the inner surface of the overmold adaptor sleeve of the plug connector. This ensures in a particularly suitable manner that it is not possible during the overmolding process for any synthetic material overmolding mass to spread into the contact chambers and possibly to pass through the contact chambers and reach the plug face of the plug connector.

A further aspect of the present invention relates to a method for producing a previously mentioned overmolded plug connector, said method comprising the following steps:

a. Connect a cable to contacts on a plug connector;
b. Fixedly screw the overmold adaptor sleeve on the plug connector housing with the result that the cable extends through the overmold adaptor sleeve;
c. Preferably introduce a casting mass between the sheath of the cable and the inner surface of the overmold adaptor sleeve and
d. Overmold the plug connector in the region of the overmold adaptor sleeve collectively with a cable section of the cable, said section being located directly at the cable entry-side feedthrough opening.

Other advantageous further developments of the invention are characterized in the subordinate claims or further illustrated below together with the description of the preferred embodiment of the invention with the aid of the figures. In the drawing:

The invention is further explained below with reference to FIGS. 1 to 6, wherein like reference numerals refer to like functional and/or structural features.

Figure 1:
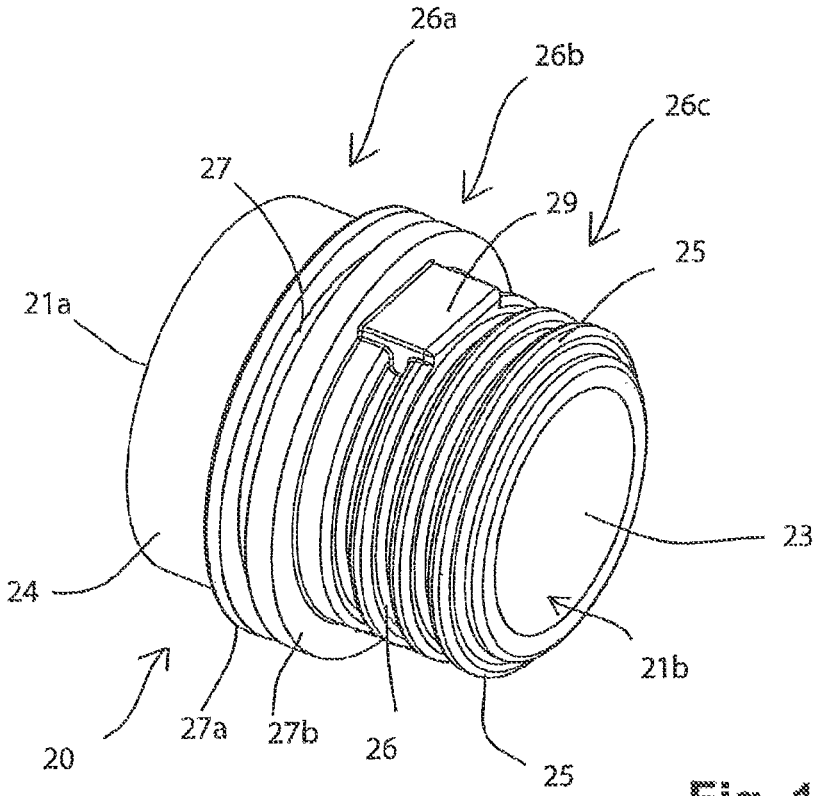
FIG. 1 illustrates a perspective view of an overmolded adaptor sleeve.
Figure 2:
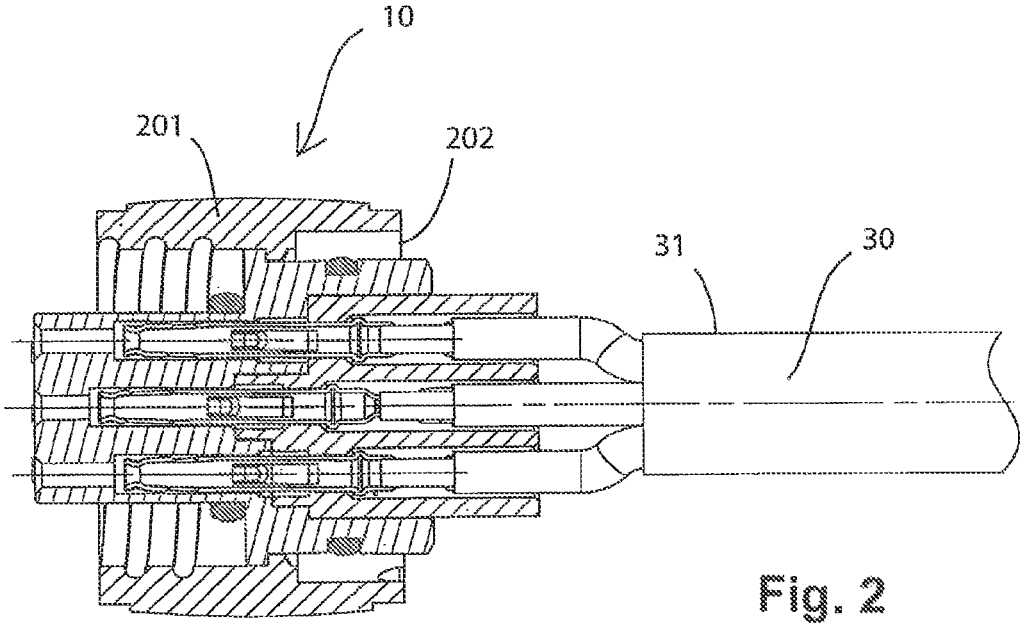
FIG. 2 illustrates a sectional view through a plug connector housing having a contact carrier and having a cable without an overmold adaptor sleeve being assembled.
Figure 3:
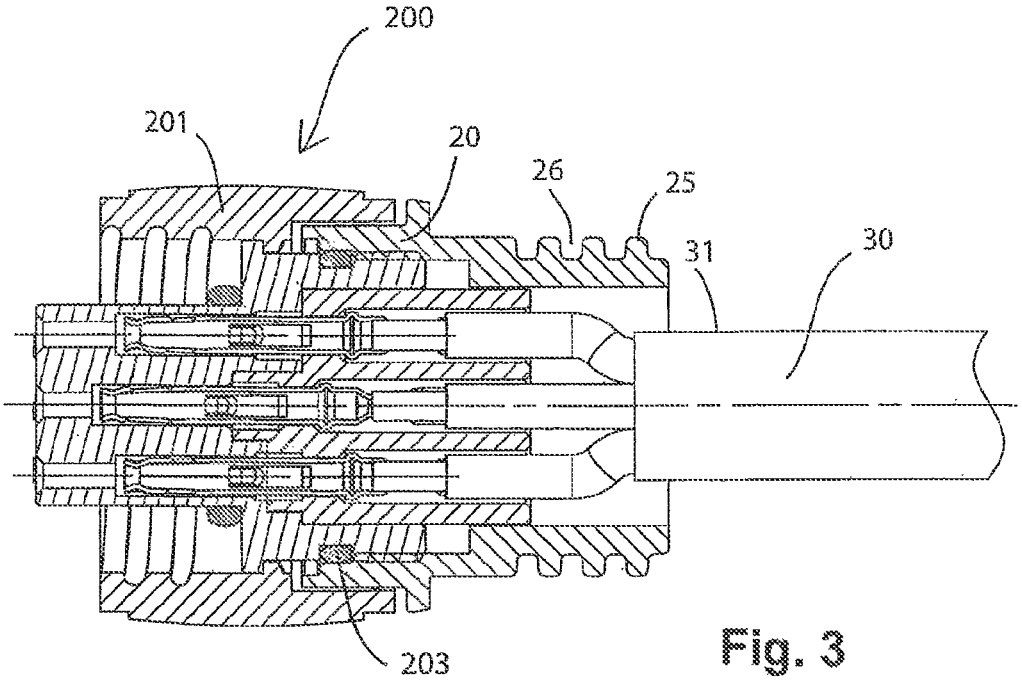
FIG. 3 illustrates a sectional view similar to FIG. 2, wherein moreover an overmold adaptor sleeve in accordance with the invention is screwed on the plug connector housing.

FIG. 3 illustrates an arrangement 100 comprising a plug connector housing 10 as is illustrated in FIG. 2 and an overmold adaptor sleeve 20 as is illustrated in FIG. 1.

The overmold adaptor sleeve 20 has a cylindrical shape that is open at both ends and is configured with a thread for screwing to the plug connector housing 10. The overmold adaptor sleeve 20 therefore comprises a corresponding screw thread 22 at the end 21*a* so as to be able to screw, in other words connect, said screw thread to the mating thread 12 of the plug connector housing 10.

The overmold adaptor sleeve 20 comprises moreover an inner extending channel 23 for feeding through a cable 30, wherein multiple ribs 25 are provided on the outer surface 24 of the overmold adaptor sleeve 20 and grooves 26 remain between said ribs. The ribs 25 and grooves 26 are used to grip an overmolding and are expediently provided so as to achieve the collective overmolding with an injectable synthetic material in an overmolding tool with a cable 30, as is illustrated in the sectional view in FIG. 4.

As is moreover illustrated in FIG. 1, the ribs 25 and thus the grooves 26 extend completely around the overmold adaptor sleeve 20.

The overmold adaptor sleeve 20 comprises a housing-side section 26*a*, a cable entry-side section 26*b*, and an intermediate section 26*c* that lies between the two said sections, wherein the ribs 25 and the grooves 26 are provided in the region of the cable entry-side section 26*b*.

Figure 5:
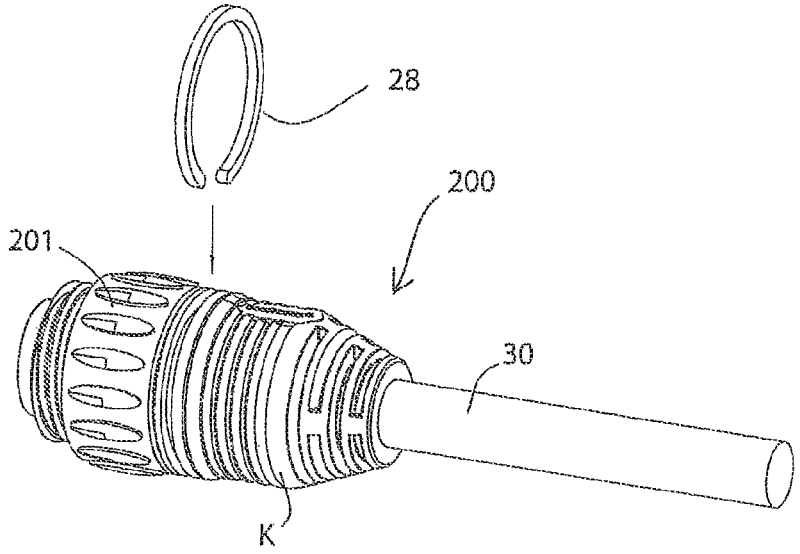
FIG. 5 illustrates a perspective view of the plug connector shown in FIG. 4 with an adaptor ring in a position ready for assembly.

A receiving groove 27 is provided adjacent thereto and in fact in the intermediate section 26*c*, said receiving groove being provided so as to receive a resilient annular or part-annular adaptor element 28 that may be introduced or clipped into the receiving groove 27, as is evident in the perspective view of FIG. 5.

The receiving groove 27 is provided between two collars 27*a*, 27*b* that protrude toward the outer periphery in the housing-side section 26*a* and also toward the outer periphery in the cable entry-side section 26*b*, as is evident in FIG. 1.

It is further evident in FIG. 1 that the overmold adaptor sleeve 20 comprises moreover a key flat 29 for engaging with a tool, wherein a non-visible further key flat 29 is provided lying diametrically opposite with respect to the key flat 29 illustrated in this view, with the result that it is possible to screw on the overmold adaptor sleeve 20 using a key tool that comprises two diametrically opposite key flats.

It is particularly advantageous if the overmold adaptor sleeve 20 may be screwed on using a torque key with the result that it is possible to achieve specific conditions for the sealing and screw connecting procedures.

Figure 4:
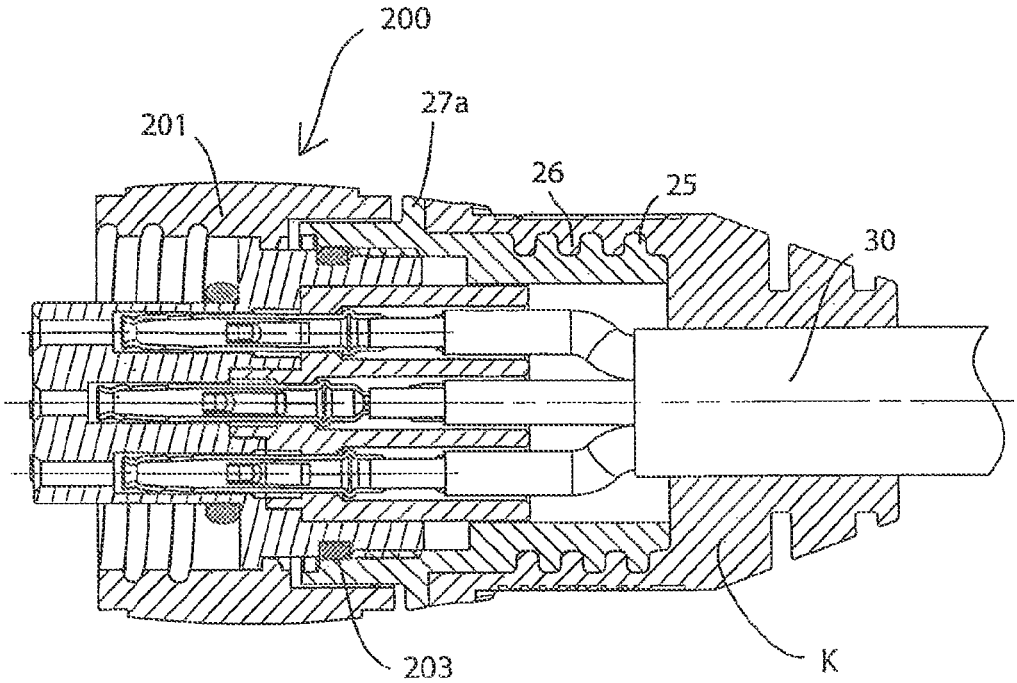
FIG. 4 illustrates a sectional view through an exemplary embodiment of a plug connector in accordance with the invention with an overmolding.
Figure 6:
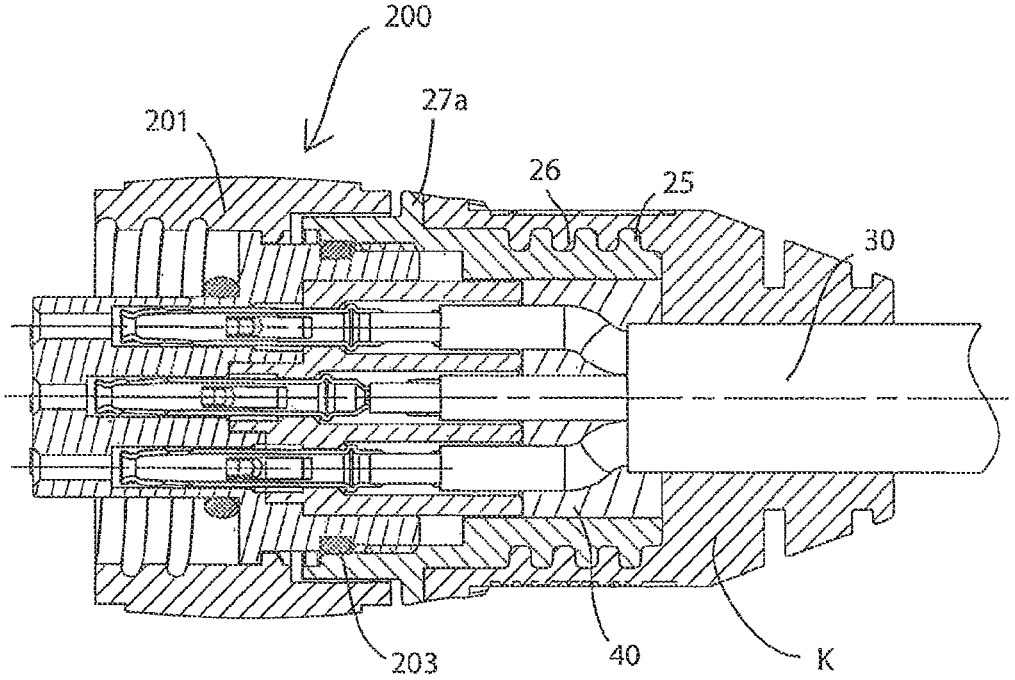
FIG. 6 illustrates a sectional view similar to the illustration in FIG. 4 wherein moreover a casting is provided.

FIGS. 4 to 6 illustrate an overmolded plug connector 200 that is pre-assembled with a cable 30. The plug connector 200 comprises the previously mentioned overmold adaptor sleeve 20 that is screwed to the plug connector housing 10 via the thread 22 and is provided with a synthetic material overmolding K in the region of the multiple ribs 25 and grooves 26, wherein the synthetic material overmolding K encompasses at least a part of the cable sheath 31 of the cable 30 in a positive-locking manner.

The plug connector 200 comprises moreover a rotatably mounted screw connection sleeve 201 for screwing to a mating plug connector that is configured in a corresponding manner and not further illustrated.

It is further evident in the sectional view in FIG. 4 that an annular gap 202 is provided between the screw connection sleeve 201 and the plug connector housing 10, said annular gap being configured open in the plug-in direction or opposite to the plug-in direction when the overmold adaptor sleeve 20 is not assembled, as is evident in FIG. 2, with the result that the overmold adaptor sleeve 20 may be screwed with its collar-shaped, housing-side section 26*a* by means of a screw connection into this annular gap 202. In this state, the annular, housing-side section 26*a* of the overmold adaptor sleeve 20 consequently protrudes into the annular gap 202, said annular, housing-side section being provided with the thread of the overmold adaptor sleeve 20.

Moreover, it is evident in the sectional view illustrated in FIG. 4 that a seal 203 is arranged between the annular, housing-side section 26*a* of the overmold adaptor sleeve 20 and the plug connector housing 10 in the region of the annular gap.

A similar view is illustrated in FIG. 6, wherein in this case moreover a casting mass 40 has been introduced between the cable sheath 31 of the cable 30 and the inner surface 20*a* of the overmold adaptor sleeve 20.

The invention is not limited in its design to the aforementioned preferred exemplary embodiments. On the contrary, a number of variants are conceivable that make use of the illustrated solution even in the case of embodiments that are designed fundamentally differently.

It is thus possible by way of example, as illustrated in the sectional view in FIG. 6, also to omit the gap for the annular adaptor element 28 and merely for a collar 27*a* to protrude at the outer periphery of the overmold adaptor sleeve 20. This collar 27*a* is used as a contact area with the result that the overmolding may reach the collar 27*a* in an overmolding tool.

LIST OF REFERENCE NUMERALS

10 Plug connector housing
12 Mating thread
20 Overmold adaptor sleeve
20*a* Inner surface
21*a* End
21*b* Feedthrough opening
22 Thread
23 Channel
24 Outer surface
25 Ribs
26 Grooves
26*a* Housing-side section
26*b* Cable entry-side section
26*c* Intermediate section
27 Receiving groove
27*a*, 27*b* Collar
28 Adaptor element
29 Key flat
30 Cable
31 Cable sheath
32 Cable section
40 Casting mass
100 Arrangement
102 Contacts
200 Plug connector
201 Screw connection sleeve
202 Annular gap
203 Seal
K Synthetic material overmolding

The invention claimed is:

1. An arrangement comprising:

a plug connector housing and a cylindrical overmold adaptor sleeve for screwing to the plug connector housing, wherein the overmold adaptor sleeve comprises a thread at one end so as to be connected to a mating thread of the plug connector housing and the overmold adaptor sleeve comprises an inner extending channel for feeding through a cable, wherein multiple ribs or grooves are provided on the outer surface of the overmold adaptor sleeve and the region that comprises the ribs or grooves is configured so as to achieve the collective overmolding with a synthetic material in an overmolding tool with a cable (30), wherein the overmold adaptor sleeve is screwed to the plug connector housing and is provided in the region that comprises multiple ribs or grooves with a synthetic material overmolding, wherein the synthetic material overmolding encompasses at least one part of the cable sheath of the cable in a positive-locking manner, and wherein the plug connector comprises on the plug connector housing a rotatably mounted screw connection sleeve for screwing to a correspondingly configured mating plug and provided between the screw connection sleeve and the plug connector housing is an annular gap into which protrudes an annular, housing-side section of the overmold adaptor sleeve, said annular, housing-side section being provided with the thread of the overmold adaptor sleeve.

2. The arrangement as claimed in claim 1, wherein the ribs or grooves of the overmold adaptor sleeve are provided on the outside in part or completely extending around the overmold adaptor sleeve.

3. The arrangement as claimed in claim 1, characterized in that wherein the overmold adaptor sleeve is formed from a housing-side section, a cable entry-side section and an intermediate section that lies between the two said sections, wherein the ribs or grooves are provided in the region of the cable entry-side section.

4. The arrangement as claimed in claim 3, the intermediate section is provided with a receiving groove into which a resilient annular or part-annular adaptor element is introduced or releasably clipped.

5. The arrangement (100) as claimed in claim 4, wherein the receiving groove between two collars that protrude toward the outer periphery in the housing-side section and also toward the outer periphery of the cable entry-side section.

6. The arrangement as claimed in claim 1, wherein two diametrically opposite key flats are provided on the overmold adaptor sleeve so as to engage with a tool.

7. The plug connector as claimed in claim 1, wherein a seal is arranged in the region of the annular gap between the annular, housing-side section of the overmold adaptor sleeve and the plug connector housing.

8. The plug connector as claimed in claim 1, wherein a casting mass is introduced between the cable sheath of the cable and the inner surface of the overmold adaptor sleeve.

9. A method for producing an overmolded plug connector as claimed in claim 1, comprising the steps of:

a. Connect a cable to contacts on a plug connector;

b. Fixedly screw the overmold adaptor sleeve on the plug connector housing with the result that the cable extends through the overmold adaptor sleeve;

c. Introduce a casting mass between the cable sheath of the cable and the inner surface of the overmold adaptor sleeve and d. Overmold the plug connector in the region of the overmold adaptor sleeve collectively with a cable section of the cable, said section being located directly at the cable entry-side feedthrough opening.

10. A method for modifying a reconnectable plug connector having a releasable cable screw connection to produce a non-reconnectable plug connector as claimed in claim 1, comprising the steps of:

a. Release and remove the cable screw connection;

b. Attach the overmold adaptor sleeve and c. Overmold the plug connector in the region of the overmold adaptor sleeve collectively with a cable section of the cable that is located directly at the cable entry-side feedthrough opening.

* * * * *